US005766533A

United States Patent [19]

Mears et al.

[11] Patent Number: 5,766,533

[45] Date of Patent: Jun. 16, 1998

[54] PROCESS AND DEVICE FOR COOL MELT-EXTRUDED FILAMENTS

[75] Inventors: Ronald Mears, Grossostheim; Erich Czase, Hüsbach; Willi Kretzschmar, Neumünster, all of Germany

[73] Assignee: Rieter-Automatik GmbH, Grobostheim, Germany

[21] Appl. No.: 716,408

[22] PCT Filed: Jan. 17, 1996

[86] PCT No.: PCT/DE96/00089

§ 371 Date: Dec. 2, 1996

§ 102(e) Date: Dec. 2, 1996

[87] PCT Pub. No.: WO96/22409

PCT Pub. Date: Jul. 25, 1996

[30] Foreign Application Priority Data

Jan. 21, 1995 [DE] Germany ..... 195 01 826.5

[51] Int. Cl.[6] ..... D01D 5/088; D01D 5/092

[52] U.S. Cl. ..... 264/211.14; 264/237; 425/71; 425/72.2; 425/464

[58] Field of Search ..... 264/211.14, 237; 425/71, 72.2, 464

[56] References Cited

U.S. PATENT DOCUMENTS

| | | | |
|---|---|---|---|
| 4,425,293 | 1/1984 | Vassilators | 264/178 F |
| 4,973,236 | 11/1990 | Hasegawa et al. | 425/72.2 |
| 5,268,133 | 12/1993 | Cuculo | 264/178 F |

FOREIGN PATENT DOCUMENTS 386034 10/1973 U.S.S.R. .

OTHER PUBLICATIONS

International Search Report, Jun. 6, 1996.

Abstract of Japan 6-330,403 (Published Nov. 29, 1994).

*Primary Examiner*—Leo B. Tentoni

*Attorney, Agent, or Firm*—Dority & Manning

[57] ABSTRACT

For the cooling of melt-extruded filaments of fiber-forming polymers spun from nozzle in molten form, said filaments are exposed to a medium prepared in foam form. The filaments emerging from the spinning nozzle are taken to the cooling area through said foam before passing on to a further process. The cooling medium, consisting of a liquid, is prepared by the addition of a gas.

23 Claims, 3 Drawing Sheets

PROCESS AND DEVICE FOR COOL MELT-EXTRUDED FILAMENTS

BACKGROUND OF THE INVENTION

The present invention relates to a process to cool melt-extruded filaments made of thread-forming polymers, as well as a device to carry out the process.

Filament yarns and extruded fibers made of thread-forming polymers such as polyester, polyamide or polyolefine are conventionally produced in the melt-extrusion process. In this process, a molten mass of polymer is fed to a viscose pump which conveys the molten mass through the extrusion nozzles in the so-called extrusion block. The molten mass emerging from the nozzles in the form of liquid filaments congeal as they emerge in a cooling shaft. Subsequently simultaneous preparation, i.e. humidification of the equipment with an antistatic preparation and similar products also takes place before the filaments are conveyed to a further process. Cooling of the liquid filaments emerging from the extrusion nozzle has here a great influence on the titer uniformity (Ust value) and on the technological textile properties of the fiber and yarn in the end products. In some applications, e.g. with high individual titers, the yarn strength drops off as the production speed is increased (g/min/hole) (U.S. Pat. No. 4,973,236). The reason for this, among other things, is insufficient cooling of the molten stream coming out of the nozzle opening.

As a rule air, but sometimes also water is used as the cooling medium.

Air cooling has the advantage that the air exerts little friction on the emerging filaments so that undesirable drafting is avoided. However, the insufficient cooling action of the air is a disadvantage, so that a long cooling distance is necessary. However, a long cooling distance means slow cooling. Slow cooling favors the formation of crystallite in the yarn, and this causes problems in subsequent drafting. A high through-put capacity (g/min/opening) or thicker individual filaments require an especially long cooling distance, since the cooling speed is low. As mentioned above, this involves the danger of crystal formation in particular with this spun material.

Cooling is usually effected by blowing across the filaments. The air stream must be relatively free of turbulence here, and must move at a uniform speed over the funnel width so that every filament may be subjected to the same amount of cooling at the same time and location. Perforated metal sheets or sieve webs in combination with honeycombs are used in order to produce the required flow conditions. It is also possible to provide a speed profile over the height of the cooling funnel. In spite of these measures, which are expensive at this time, even cooling of all individual filaments is not ensured in case of a high number of filaments per surface. With lateral blowing, a temperature gradient is produced from filament to filament, so that the number opening rows provided for in the air stream is limited.

From U.S. Pat. No. 4,425,293 it is also known to use water as the cooling medium. The advantage of water cooling is rapid removal of the heat and therefor avoidance of extrusion crystallization. However a high degree of friction between water and filament is a disadvantage in water cooling. This may lead to undesirable drafting of the filaments. It has already been tried to calculate and design the undesirable drafting during water cooling so that a desired drafting takes place (U.S. Pat. No. 5,268,133 and WO 91/181 133). However such measures have been shown to be complicated and not without problems.

OBJECTS AND SUMMARY OF THE INVENTION

It is a principal object of the present invention to create a process which improves the cooling of the molten extrusion mass emerging from the nozzles and thereby to also make the spinning of stronger filaments at higher speed possible without crystal formation in these filaments which would have a disadvantageous influence on the subsequent drafting or drafting/extruding process. Additional objects and advantages of the invention will be set forth in part in the following description, or may be obvious from the description, or may be learned through practice of the invention.

It has been shown that by using foam, the cooling action is surprisingly increased considerably without producing the great hydrodynamic frictional force of the filaments which is known to take place with water. The formation of a liquid film on the filament surface achieves however the nearly identical cooling effect as water. The process according to the invention also avoids the disadvantage of the lateral blowing.

Further advantages of the invention result from the fact that the construction of extrusion installations can be achieved with very low constructive height because of the drastically reduced cooling distance. This results in considerable savings. Further details of the invention are described through the figures.

DETAILED DESCRIPTION OF THE PREFERRED EMBODIMENTS

Figure 1:
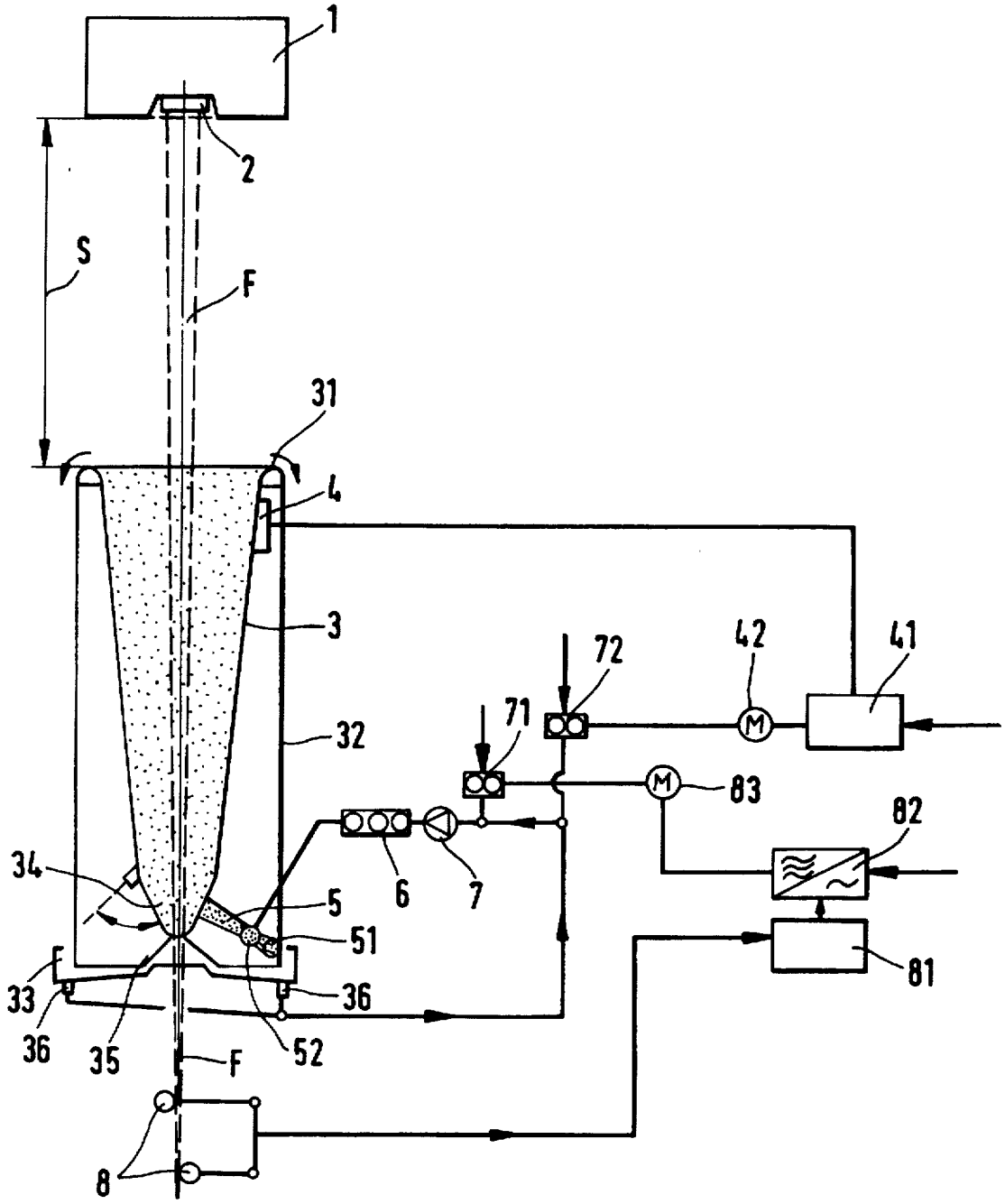
FIG. 1 schematically shows an installation for the spinning of melt-extruded filaments made of yarn-forming polymers, whereby the parts of the installation which are not essential to the invention have been omitted.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment can be used on another embodiment to yield still a third embodiment. It is intended that the present invention cover such modifications and variations.

Figure 3:
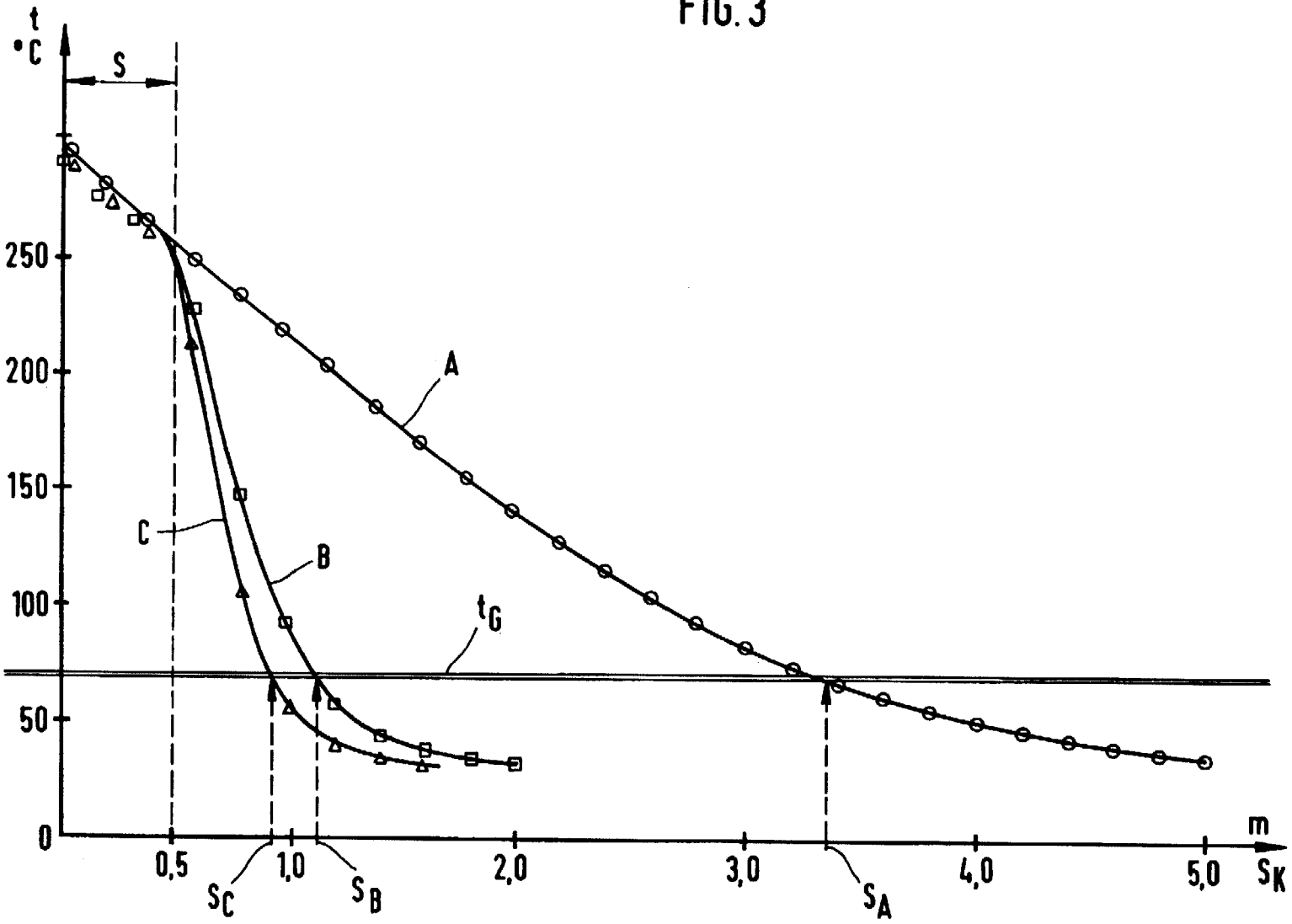
FIG. 3 is a graphic representation of the cooling process according to the state of the art and according to the invention.

Extrusion nozzles 2 from which the filaments F emerge are installed on an extrusion block 1. Before these filaments F leave the nozzles 2 in liquid form and can be conveyed to any further processing step, they must be congealed by cooling so that they can be wound up on bobbins, for example, or be deposited in the form of yarn bundles in cans. For this reason, the run through a so-called cooling path SK (FIG. 3) on which the yarns are conveyed freely, without touching each other or other objects, and where they are cooled down from the usual melting temperature of approximately 300° C. to a limit temperature $t_G$ which is around 70° C. Only when this limit temperature $t_g$ has been reached or when the temperature has fallen below it, are the filaments F allowed to make contact. In FIG. 3, the temperature t of the spun material is shown at distances in meters (m) in degrees centigrade over the path SK which the spun material must cover until it has been cooled down to a given temperature. This line $t_g$ indicates the temperature to which the spun material must be at least cooled before any contact is made (limit temperature). The cooling conditions for a polyester POY monofilaments of titer 22–35 dtex for example, are represented by the curve A. In this case cooling takes place as usually by air with its own temperature corresponding to the room temperature of approximately 20° C. The course of cooling shows that, in this type of cooling and at a production speed of 3600 m/min, the limit temperature of approximately 70° C. is reached only after a cooling path SA of approximately 3.5 m. Only at this distance from the nozzle have the filaments reached sufficient strength through cooling so that they may come into contact with each other or also with yarn guiding elements etc.

If the product speed is increased or a thicker titer is spun, an even longer cooling path SK which may be as long as 5 or even 6 meters is required. The disadvantage of such a long cooling path have been mentioned earlier. Since a first contact of the filaments F may only occur at this distance from the nozzle, this means that the entire installation reaches a great constructive height. Because of these dimensions, the installations becomes more expensive, aside from the fact that the filaments F are also exposed to uncontrolled influences on the cooling path.

The use of water would certainly shorten the cooling path due to good heat transfer. However, great disadvantages occur because of the strong friction between water and filaments. Surprisingly it has now been shown that with foam a similarly strong cooling action can be reached as with water. However, the damaging friction between filament and foam does not occur as with water.

The cooling conditions for foam with different shares in volume of liquid are shown in curves B and C in FIG. 3. From this it can be seen that for a foam with a liquid volume share of 5%, the cooling path is shortened to approximately 1.1 to 1.2 meters under the same conditions as for curve A. With a higher share in volume the cooling path is further shortened because heat transfer also increases considerably as a function of the volume share of liquid in the foam. Thus, curve C for example shows the cooling course for a foam with approximately 10% of liquid volume share. Here the cooling path SK is shortened to the length of path SC which is less than 1 meter long, in order to reach the limit temperature.

In FIG. 3 the overall cooling course is shown, from the emergence from the extrusion nozzles to the preparation for the next treatment process. In air gap S between nozzle plate 2 and foam container 3 a relatively flat course of the temperature drop is noted. With entry into the foam, the cooling curve becomes noticeably steeper than if cooling were to be effected only by air, and thus reaches the limit temperature $t_g$ after only a short distance.

It need not be said that this considerable shortening of the cooling path SK not only improves the technological characteristics and production conditions considerably for heaver titer, but that also much smaller dimensions of the spinning installation can be achieved. The heights can easily be reduced to one half to one third, and this leads to considerable savings in the installation of such equipment.

As appears from FIGS. 1 and 2, a foam container 3 or 30 is installed below the extrusion block 1 and the nozzle plate 2, at a distance S. The distance S may be very short, e.g. only 1–2 cm. Its size depends on the filament thickness and on production speed. Since the filaments F emerge in liquid form from the nozzles 3, a certain amount of congealing is necessary before they dip into the foam. This congealing is considerably quicker with thin filaments than with thicker titers, where this distance from the foam may be up to 1.5 m, depending on production speed.

The foam container 3 is supported by a frame 32 and has on additional input opening 31 at its upper end so that the filaments F cannot touch the sides of the foam container 3, while an opening 35 through which the filaments F leave the foam container is provided at its lower end. Due to the widening cross-section of the foam container 3, the speed of flow of the foam is reduced and the formation and separation of the liquid is thus promoted so that the spun material conveyed in the counter-current through the foam is wetted and cooled intensively. Since the filaments F fill out this narrow opening 35 to a great extent and in order to avoid any contacts, the limit temperature $t_g$ must have been reached with certainty by this point in time. As can be seen in FIG. 3, this determines also the height of the foam container 3.

At the lower end, close by the output opening 35, a foam producer 5 is installed which has an air feed 51 and a cooling liquid feed 52 and which feeds the foam directly into the lower part of the foam container 3. While the foam rises continuously due to the continuous foam production, the filaments F are conveyed in the counter-current from the top down through the foam container 3 and emerge from the foam container 3 at the output opening 35 to be then conveyed to a further process. The rising foam is controlled by a sensor 4 which regulates the level, in some cases via level regulator 41. The edge of the upper input opening 31 of the foam container 3 is made as an overflow spillway so that the liquid which forms again may flow off over the edge if necessary. The overflowing liquid as well as the liquid produced in the foam container 3, because it forms again and flows downward, is collected in a collecting trough 33 and is fed back to the circulation pump 7 via discharge line 36.

The foam producer 5 is fed continuously by the circulation pump 7 which also products the circulation of the liquid fed back from the foam container 3. Water is brought into the circuit by the dosage pump 72, to the extent that liquid is consumed by foam production and cooling of the filaments F. A second pump 71 feeds preparation oil to the liquid. Both are then pumped by the circulation pump 7 through a mixer 6 and are thus added to the liquid which is fed via line 52 to the foam producer 5. In the foam producer 5, air is added to the liquid through air feed 51 and foam is thus produced which is delivered in the lower part of the foam container 3.

At the beginning of spinning, the foam container 3 is at first empty. The filaments F emerging from the nozzle 2 fall down into the foam container 3 and are introduced into the output opening 35. For this, a shutter 34 is used which makes the lower part of the foam container 3 accessible. After introduction of the filaments F the shutter 34 is closed again and the foam is brought in. The sensor 4 checks the rising foam and regulates via a regulator 41 the motor 42 which drives the water dosage pump 72 for water arrival. Thus, the level in the foam container which is controlled by the sensor 4 also determines the cooling path length SK which the filaments require as they go through the foam.

In the process of filament cooling by foam according to the invention, the foam bath is used simultaneously to apply the preparation solution on the filaments F. The installation according to the invention thus also contains the necessary preparation device. Below the foam container 3, the emerging filaments are scanned by two electrodes 8. The constancy of the preparation coat is thus measured by means of a resistance measurement, and if necessary by means of a desired value/actual value comparison in the concentration regulator 81 and a frequency converter which drives the motor 83 of the dosage pump 71 for the preparation oil.

Figure 2:
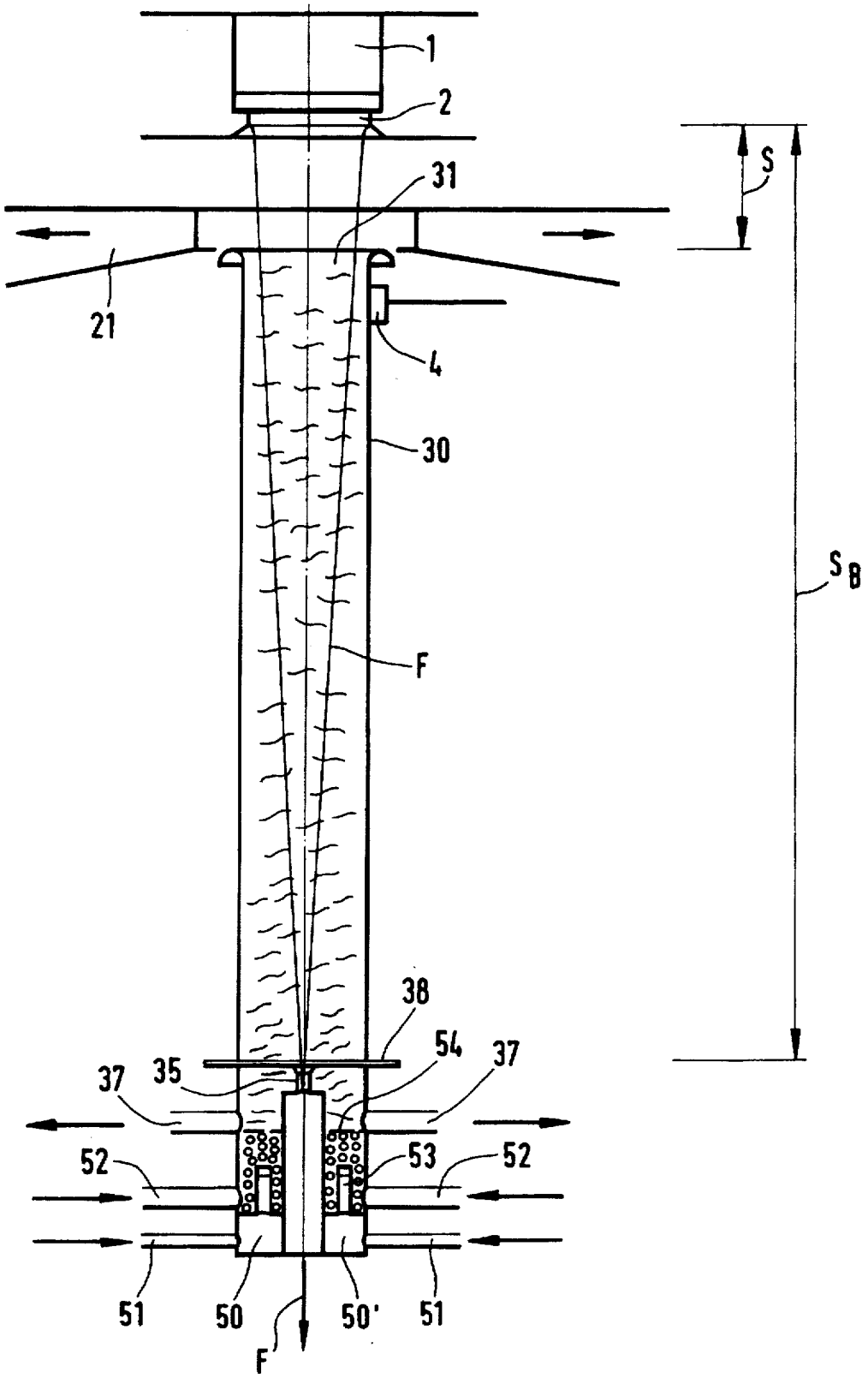
FIG. 2 shows another embodiment of the foam equipment.

In the embodiment of FIG. 2, the foam container is somewhat different in design from FIG. 1. The foam container 30 is made in the form of a rectangular or cylindrical funnel to which the foam producer 50, 50' is connected in continuation of its external form, but separated by a commissure 38. The narrow output opening 35 of the foam container 3 is here included into the foam producer 50, 50', so that the foam container 3 is open over the full cross-section at the commissure 38.

The foam producer consists of two half-cups 50, 50' which are able to move apart in horizontal direction, along the commissure 38. As a result, the lower part of the foam container 30 becomes accessible for spinning, so that the dropping filaments F can be seized and be inserted into the yarn guide for further processing. Once this has been accomplished, the two half-cups 50, 50' of the foam producer are again joined together so they enclose the filaments F and so that the foam container 30 is closed with the exception of the output opening 35 for the filaments F.

Either of the two half cups 50, 50' is made as an independent foam producer and is connected to an air feed 51 as well as to a liquid feed 52. These feed lines are advantageously elastic so that the two half-cups 50, 50' can be moved apart. The two half-cups 50, 50' are mounted advantageously on an axis vertically to the commissure 38 at their one end for this, so that the half-cups 50, 50' can be opened for the insertion of the filaments F. In each of the half-cups 50, 50', sintered metal plugs 52 are installed through which the air and the liquid are fed. Instead of going through the sintered metal plugs 53, the air can also be fed through a plate or any other form of a body made of sintered metal. Preferably however, the commercially available sintered metal plugs are used for the air arrival.

The utilization of sintered material produces extremely good mixing of the liquid with gas, preferably air, into foam. Other fine-porous elements can of course also be used for the gas arrival into the liquid, such as sieves, nozzle plates, etc.

The liquid level 54 in the foam producer 50, 50' is controlled by a level limiter 37 to ensure uniform foam production. The simplest type of such a level limiter 37 is shown in FIG. 2 in the form of an overflow spillway. Instead of the overflow spillway 37, a probe can be provided which controls the arrival of liquid. The foam produced in this manner rises into the foam container 30 while the filaments F run through the foam container in the counter-current and leave through the output opening 35.

The upper part of the foam container 30 is made in similar manner as in the described embodiment according to FIG. 1. Here too, the edge of the opening 31 is made in the form of an overflow spillway so that the liquid forming again collects and is able to drip off over this edge to be caught and to be reintroduced into the circuit for foam production.

The sensor 4 regulates the level of the foam inside container 30, but it may become necessary to take further measures so that the foam surface is even and so that thus all the filaments F go through the same cooling path SB through the foam. To avoid the formation of a foam mound at the input opening 31 of the foam container, a device for the smoothing of the foam surface can be provided additionally. In the embodiment shown, a suction channel 21 is provided which removes such a foam mound or prevents the formation of such a foam mound by means of a slight air stream.

The distance S from the nozzle plate 2 is shown substantially shorter than in FIG. 1. As mentioned earlier, this distance depends on the filament speed and the titer of filaments F. A certain distance S must however be respected, since the foam must not touch the nozzle plate 2 in order to avoid undesirable cooling of same by the foam. Such a device 21 for the smoothing of the foam surface also makes a certain distance from the nozzle plate necessary.

It should be appreciated by those skilled in the art that various modifications and variations can be made in the present invention without departing from the scope and spirit of the invention. It is intended that the present invention cover such modifications and variations as come within the scope of the appended claims and their equivalents.

What is claimed is:

1. A process for cooling melt-extruded filaments of yarn forming polymers wherein a molten mass of the polymer emerges from an extrusion nozzle forming liquid filaments, said process comprising cooling the liquid filaments in a cooling zone by conveying the filaments through a foam cooling medium in the cooling zone in a direction counter to a direction of flow of the foam cooling medium, and controlling the upper surface of the foam cooling medium in the cooling zone so that the foam cooling medium does not contact the extrusion nozzle yet the filament issuing from the extrusion nozzle travels a free path between the extrusion nozzle and foam cooling medium that is just sufficient for the filaments to congeal prior to entering the foam cooling medium.

2. The process as in claim 1, further comprising forming the foam cooling medium in a foam generator and conducting the foam directly from the foam generator into a container defining the cooling zone.

3. The process as in claim 2, further comprising smoothing the upper surface of the foam cooling medium.

4. The process as in claim 3, further comprising smoothing the upper surface of the foam cooling medium by directing a stream of air across the upper surface of the foam cooling medium.

5. The process as in claim 4, further comprising directing the stream of air with a suction source.

6. The process as in claim 5, further comprising generating the foam cooling medium continuously and collecting and recirculating liquid formed as the foam cooling medium breaks down.

7. The process as in claim 1, further comprising reducing the velocity of the foam cooling medium at a point of entrance of the filament into the cooling zone.

8. The process as in claim 1, further comprising maintaining the liquid content of the foam cooling medium between about 5% to 10% fluid by volume.

9. The process as in claim 1, further comprising determining a required cooling path length for the filaments through the foam cooling medium and maintaining the foam cooling medium at a height within the cooling zone corresponding to the cooling path.

10. An apparatus for producing and cooling melt-extruded filaments of yarn from a molten mass of polymer, said apparatus comprising:

an extrusion block having a plurality of extrusion nozzles through which the molten mass of polymer is conveyed whereby molten liquid filaments emerge from said extrusion nozzles;

a cooling zone disposed vertically below said extrusion block, said cooling zone comprising a container continuously filled to a predetermined level with a foam cooling medium, said container disposed vertically below said extrusion block a distance to ensure that said foam cooling medium does not contact said extrusion block and so that said molten liquid filaments travel a free path between said extrusion block and said foam cooling medium that is just sufficient for said molten liquid filaments to congeal prior to entering said foam cooling medium; and a foam production system in communication with said container for supplying and maintaining said foam cooling medium at said predetermined level within said container.

11. The apparatus as in claim 10, wherein said container comprises a filament inlet opening in an upper end thereof with a sufficient width so that incoming filaments do not come into contact with each other or said container, and a filament outlet opening having a width which is substantially filled by exiting filaments.

12. The apparatus as in claim 10, wherein said foam production system opens directly into said container so that said foam cooling medium generated thereby is introduced directly into said container.

13. The apparatus as in claim 12, wherein said foam production system is located at a lower end of said container.

14. The apparatus as in claim 13, wherein said foam production system defines a continuation of said container.

15. The apparatus as in claim 12, wherein said foam production system further comprises a liquid supply and an air supply.

16. The apparatus as in claim 10, wherein said foam production system comprises half-cup members defining an emerging path for said filaments as they leave said container, said half-cup members movable apart to provide access to said filaments.

17. The apparatus as in claim 16, wherein each of said half-cup members comprises a self contained liquid container and air conveying element.

18. The apparatus as in claim 17, wherein said air conveying element is formed of a sintered metal.

19. The apparatus as in claim 18, wherein said air conveying elements comprises sintered metal plugs.

20. The apparatus as in claim 19, wherein said self contained liquid container further comprises a liquid level limiting device.

21. The apparatus as in claim 20, wherein said liquid level limiting device comprises an overflow device.

22. The apparatus as in claim 11, further comprising a device configured to smooth over said foam cooling medium at said inlet opening of said container.

23. The apparatus as in claim 22, wherein said device comprises a suction channel proximate said inlet opening.

* * * * *